US011021774B2

(12) United States Patent
Hatano

(10) Patent No.: US 11,021,774 B2
(45) Date of Patent: Jun. 1, 2021

(54) COPPER ALLOY PLATE HAVING EXCELLENT ELECTRICAL CONDUCTIVITY AND BENDING DEFLECTION COEFFICIENT

(71) Applicant: JX NIPPON MINING & METALS CORPORATION, Tokyo (JP)

(72) Inventor: Takaaki Hatano, Kanagawa (JP)

(73) Assignee: JX Nippon Mining & Metals Corporation, Tokyo (JP)

( * ) Notice: Subject to any disclaimer, the term of this patent is extended or adjusted under 35 U.S.C. 154(b) by 55 days.

(21) Appl. No.: 14/911,298

(22) PCT Filed: Apr. 9, 2014

(86) PCT No.: PCT/JP2014/060347
§ 371 (c)(1),
(2) Date: Feb. 10, 2016

(87) PCT Pub. No.: WO2015/022789
PCT Pub. Date: Feb. 19, 2015

(65) Prior Publication Data

US 2016/0186296 A1 Jun. 30, 2016

(30) Foreign Application Priority Data

Aug. 13, 2013 (JP) ..... JP2013-168371

(51) Int. Cl.
*C22C 9/06* (2006.01)
*H01B 1/02* (2006.01)
*C22F 1/08* (2006.01)

(52) U.S. Cl.
CPC ..... *C22C 9/06* (2013.01); *C22F 1/08* (2013.01); *H01B 1/026* (2013.01)

(58) Field of Classification Search
CPC ..... C22C 9/00; C22C 9/06
See application file for complete search history.

(56) References Cited

U.S. PATENT DOCUMENTS

2010/0269959 A1* 10/2010 Gao ..... C22C 9/00 148/554
2011/0146855 A1* 6/2011 Sakurai ..... C22C 9/00 148/682
2015/0110668 A1 4/2015 Kuwagaki

FOREIGN PATENT DOCUMENTS

EP 0949343 A1 10/1999
EP 2610359 A1 7/2013
(Continued)

OTHER PUBLICATIONS

PCT/JP2014/060347 English translation of the International Preliminary Report on Patentability (dated Feb. 16, 2016).
(Continued)

*Primary Examiner* — Anthony J Zimmer
*Assistant Examiner* — Michael J Kachmarik
(74) *Attorney, Agent, or Firm* — Faegre Drinker Biddle & Reath LLP

(57) ABSTRACT

There are provided a copper alloy plate having high strength, high electrical conductivity, a high bending deflection coefficient, and excellent stress relaxation characteristics, and an electronic component preferred for high current applications or heat dissipation applications. A copper alloy plate comprising 0.8 to 5.0% by mass of one or more of Ni and Co and 0.2 to 1.5% by mass of Si, with the balance being copper and an unavoidable impurity, having a tensile strength of 500 MPa or more, and having an A value of 0.5 or more, the A value being given by the following formula:

$$A=2X_{(111)}+X_{(220)}-X_{(200)}$$

$$X_{(hkl)}=I_{(hkl)}/I_{0(hkl)}$$

wherein $I_{(hkl)}$ and $I_{0(hkl)}$ are diffraction integrated intensities of a (hkl) face obtained for a rolled face and a copper powder, respectively, using an X-ray diffraction method.

6 Claims, 2 Drawing Sheets

(56) References Cited

FOREIGN PATENT DOCUMENTS

| | | | |
|---|---|---|---|
| JP | 58128292 | A | 7/1983 |
| JP | 2002038227 | A | 2/2002 |
| JP | 2002275563 | A | 9/2002 |
| JP | 2006283059 | A | 10/2006 |
| JP | 2008013836 | A | 1/2008 |
| JP | 2009007625 | A | 1/2009 |
| JP | 2009007666 | A | 1/2009 |
| JP | 2010275622 | A | 12/2010 |
| JP | 2011017072 | A | 1/2011 |
| JP | 2011084764 | A | 4/2011 |
| JP | 2011106005 | A | 6/2011 |
| JP | 4857395 | B1 | 1/2012 |
| JP | 2012177197 | A | 9/2012 |
| JP | 2013104082 | A | 5/2013 |
| JP | 2013227600 | A | 11/2013 |
| JP | 2013227642 | A | 11/2013 |
| JP | 5427971 | B1 | 2/2014 |
| WO | 2011068121 | A1 | 6/2011 |
| WO | 2011068134 | A1 | 6/2011 |

OTHER PUBLICATIONS

PCT/JP2014/060347, English translation of the Written Opinion of the International Searching Authority (dated Jun. 24, 2014).

* cited by examiner

[Figure 1]
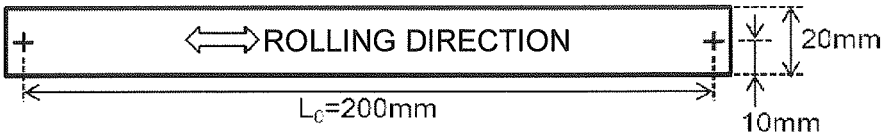
[Figure 2]
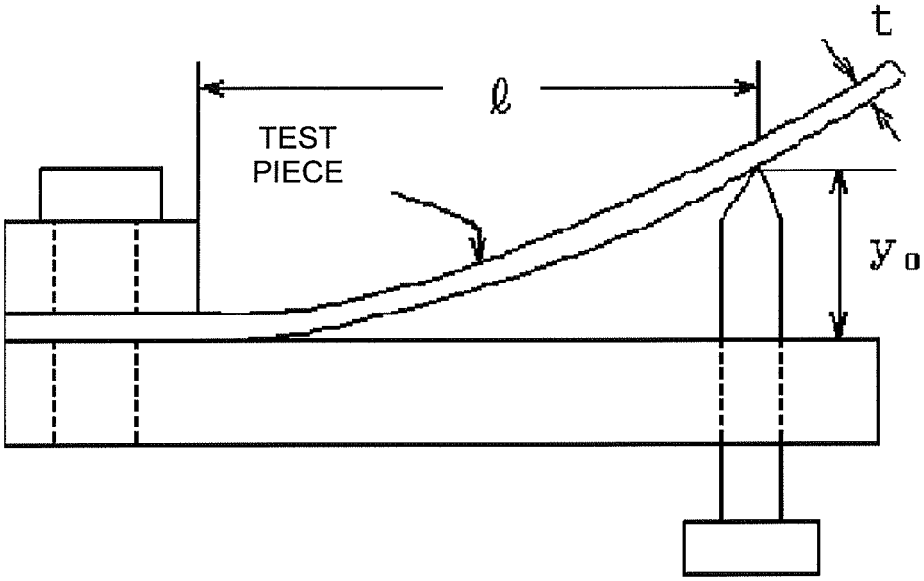

[Figure 3]
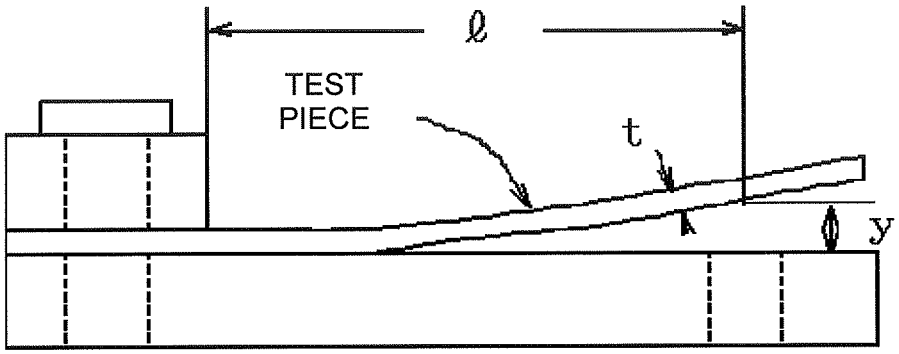

COPPER ALLOY PLATE HAVING EXCELLENT ELECTRICAL CONDUCTIVITY AND BENDING DEFLECTION COEFFICIENT

TECHNICAL FIELD

The present invention relates to a copper alloy plate and a current-carrying or heat-dissipating electronic component and particularly to a copper alloy plate used as the raw materials of electronic components such as terminals, connectors, relays, switches, sockets, bus bars, lead frames, and heat-dissipating plates mounted in electrical and electronic equipment, cars, and the like, and an electronic component using the copper alloy plate. The present invention especially relates to a copper alloy plate preferred for applications for high current electronic components such as high current connectors and terminals used in electric cars, hybrid cars, and the like, or applications for heat-dissipating electronic components such as liquid crystal frames used in smartphones and tablet PCs, and an electronic component using the copper alloy plate.

BACKGROUND ART

Components for conducting electricity or heat, such as terminals, connectors, switches, sockets, relays, bus bars, lead frames, and heat-dissipating plates, are incorporated in electrical and electronic equipment, cars, and the like, and copper alloys are used for these components. Here, electrical conductivity and thermal conductivity are in a proportional relationship.

In recent years, with the miniaturization of electronic components, an increase in the bending deflection coefficient has been required. When a connector or the like is miniaturized, it is difficult to make the displacement of the plate spring large. Therefore, it is necessary to obtain high contact force with small displacement, and a higher bending deflection coefficient is required.

In addition, when the bending deflection coefficient is high, springback in bending work decreases, and press molding is easy. In high current connectors and the like for which thick materials are used, particularly this merit is large.

Further, heat-dissipating components referred to as liquid crystal frames are used for the liquid crystals of smartphones and tablet PCs, and also in copper alloy plates for such heat dissipation applications, a higher bending deflection coefficient is required because when the bending deflection coefficient is increased, the deformation of a heat-dissipating plate when external force is applied is reduced, and the protection properties for a liquid crystal component, an IC chip, and the like disposed around the heat-dissipating plate are improved.

Here, the plate spring portion of a connector or the like is usually taken in the direction in which its longitudinal direction is orthogonal to the rolling direction (the bending axis in bending deformation is parallel to the rolling direction). This direction will be referred to as the plate width direction (TD) below. Therefore, an increase in the bending deflection coefficient is particularly important in TD.

Meanwhile, with the miniaturization of electronic components, the cross-sectional area of a copper alloy in a current-carrying portion tends to decrease. When the cross-sectional area decreases, heat generation from the copper alloy when current is carried increases. In addition, electronic components used in booming electric cars and hybrid electric cars include components through which significantly high current is passed, such as connectors for battery portions, and the heat generation of the copper alloys when current is carried is a problem. When heat generation is excessive, the copper alloys are exposed to a high temperature environment.

In the electrical contact of an electronic component such as a connector, deflection is applied to the copper alloy plate, and contact force in the contact is obtained by stress generated by this deflection. When the copper alloy plate to which deflection is applied is maintained at high temperature for a long time, stress, that is, contact force, decreases due to a stress relaxation phenomenon, causing an increase in contact electrical resistance. In order to address this problem, copper alloys are required to have better electrical conductivity so that the amount of heat generated decreases, and also required to have better stress relaxation characteristics so that the contact force does not decrease even if heat is generated. Similarly, it is desired that copper alloy plates for heat dissipation applications also have excellent stress relaxation characteristics in terms of suppressing the creep deformation of heat-dissipating plates due to external force.

As copper alloys having high electrical conductivities, high strength, and relatively good stress relaxation characteristics, Corson alloys are known. The Corson alloys are alloys in which intermetallic compounds such as Ni—Si, Co—Si, and Ni—Co—Si are precipitated in Cu matrices.

Studies on Corson alloys in recent years have mainly aimed at bending workability improvement, and as measures for this, various techniques for developing {001}<100> orientation (Cube orientation) have been proposed. For example, in Patent Literature 1 (Japanese Patent Laid-Open No. 2006-283059), the area ratio of Cube orientation is controlled at 50% or more to improve bending workability. In Patent Literature 2 (Japanese Patent Laid-Open No. 2010-275622), the X-ray diffraction intensity of (200) (synonymous with {001}) is controlled at the X-ray diffraction intensity of a copper powder standard sample or more to improve bending workability. In Patent Literature 3 (Japanese Patent Laid-Open No. 2011-17072), the area ratio of Cube orientation is controlled at 5 to 60%, and simultaneously both the area ratios of Brass orientation and Copper orientation are controlled at 20% or less to improve bending workability. In Patent Literature 4 (Japanese Patent No. 4857395), in a central portion in the plate thickness direction, the area ratio of Cube orientation is controlled at 10 to 80%, and simultaneously both the area ratios of Brass orientation and Copper orientation are controlled at 20% or less to improve notch bending properties. In Patent Literature 5 (WO2011/068121), the Cube orientation area ratios of the surface layer of a material and at a depth position ¼ of the entire depth are W0 and W4 respectively, and W0/W4 and W0 are controlled at 0.8 to 1.5 and 5 to 48% respectively, and further the average crystal grain size is adjusted at 12 to 100 μm to improve 180 degree contact bending properties.

As described above, the methods for developing {001}<100> orientation are extremely effective for an improvement in bending workability but cause a decrease in the bending deflection coefficient. For example, in Patent Literature 6 (WO2011/068134), the area ratio of (100) faces facing in the rolling direction is controlled at 30% or more, and as a result the Young's modulus decreases to 110 GPa or less, and the bending deflection coefficient decreases to 105 GPa or less.

CITATION LIST

Patent Literature

[Patent Literature 1] Japanese Patent Laid-Open No. 2006-283059

[Patent Literature 2] Japanese Patent Laid-Open No. 2010-275622

[Patent Literature 3] Japanese Patent Laid-Open No. 2011-17072

[Patent Literature 4] Japanese Patent No. 4857395

[Patent Literature 5] International Publication No. WO2011/068121

[Patent Literature 6] International Publication No. WO2011/068134

SUMMARY OF INVENTION

Technical Problem

As illustrated above, conventional Corson alloys have high electrical conductivities and strength, but their TD bending deflection coefficients are not at satisfactory levels as applications for components through which high current is passed, or applications for components that dissipate a large amount of heat. In addition, conventional Corson alloys have relatively good stress relaxation characteristics, but the level of their stress relaxation characteristics cannot always be said to be sufficient as applications for components through which high current is passed, or applications for components that dissipate a large amount of heat. Particularly, a Corson alloy having both a high bending deflection coefficient and excellent stress relaxation characteristics has not been reported so far.

Accordingly, it is an object of the present invention to provide a copper alloy plate having high strength, high electrical conductivity, a high bending deflection coefficient, and excellent stress relaxation characteristics, and an electronic component preferred for high current applications or heat dissipation applications.

Solution to Problem

The present inventor has studied diligently over and over and as a result found that for a Corson alloy plate, the orientation of crystal grains oriented in the rolled face influences the TD bending deflection coefficient. Specifically, in order to increase the bending deflection coefficient, the increase of (111) faces and (220) faces in the rolled face has been effective, and on the contrary, the increase of (200) faces has been harmful.

The present invention completed based on the above finding is, in one aspect, a copper alloy plate comprising 0.8 to 5.0% by mass of one or more of Ni and Co and 0.2 to 1.5% by mass of Si, with the balance being copper and an unavoidable impurity, having a tensile strength of 500 MPa or more, and having an A value of 0.5 or more, the A value being given by the following formula:

$$A=2X_{(111)}+X_{(220)}-X_{(200)}$$

$$X_{(hkl)}=I_{(hkl)}/I_{0(hkl)}$$

wherein $I_{(hkl)}$ and $I_{0(hkl)}$ are diffraction integrated intensities of a (hkl) face obtained for a rolled face and a copper powder, respectively, using an X-ray diffraction method.

The present invention is, in another aspect, a copper alloy plate comprising 0.8 to 5.0% by mass of one or more of Ni and Co and 0.2 to 1.5% by mass of Si, further comprising 3.0% by mass or less of one or more of Sn, Zn, Mg, Fe, Ti, Zr, Cr, Al, P, Mn, B, and Ag in a total amount, with the balance being copper and an unavoidable impurity, having a tensile strength of 500 MPa or more, and having an A value of 0.5 or more, the A value being given by the following formula:

$$A=2X_{(111)}+X_{(220)}-X_{(200)}$$

$$X_{(hkl)}=I_{(hkl)}/I_{0(hkl)}$$

wherein $I_{(hkl)}$ and $I_{0(hkl)}$ are diffraction integrated intensities of a (hkl) face obtained for a rolled face and a copper powder, respectively, using an X-ray diffraction method.

In one embodiment of the copper alloy plate according to the present invention, a thermal expansion and contraction rate in a rolling direction when the copper alloy plate is heated at 250° C. for 30 minutes is adjusted at 80 ppm or less.

In another embodiment, the copper alloy plate according to the present invention has an electrical conductivity of 30% IACS or more and has a bending deflection coefficient of 115 GPa or more in a plate width direction.

In still another embodiment, the copper alloy plate according to the present invention has an electrical conductivity of 30% IACS or more, has a bending deflection coefficient of 115 GPa or more in a plate width direction, and has a stress relaxation rate of 30% or less in the plate width direction after being maintained at 150° C. for 1000 hours.

The present invention is, in another aspect, high current electronic component using the above copper alloy plate.

The present invention is, in another aspect, a heat-dissipating electronic component using the above copper alloy plate.

Advantageous Effect of Invention

According to the present invention, it is possible to provide a copper alloy plate having high strength, high electrical conductivity, a high bending deflection coefficient, and excellent stress relaxation characteristics, and an electronic component preferred for high current applications or heat dissipation applications. This copper alloy plate can be preferably used as the raw materials of electronic components such as terminals, connectors, switches, sockets, relays, bus bars, lead frames, and heat-dissipating plates and is particularly useful as the raw materials of electronic components that carry high current, or the raw materials of electronic components that dissipate a large amount of heat.

BRIEF DESCRIPTION OF DRAWINGS

FIG. 1 is a diagram for explaining a test piece for thermal expansion and contraction rate measurement.

FIG. 2 is a diagram for explaining the principle of the measurement of a stress relaxation rate.

FIG. 3 is a diagram for explaining the principle of the measurement of the stress relaxation rate.

DESCRIPTION OF EMBODIMENTS

The present invention will be described below.

(Target Characteristics)

A Corson alloy plate according to an embodiment of the present invention has an electrical conductivity of 30% IACS or more and has a tensile strength of 500 MPa or more. When the electrical conductivity is 30% IACS or more, it can be said that the amount of heat generated when current is carried is equal to that of pure copper. In addition, when the tensile strength is 500 MPa or more, it can be said that the Corson alloy plate has the strength required as the raw material of a component that carries high current, or the raw material of a component that dissipates a large amount of heat.

The TD bending deflection coefficient of the Corson alloy plate according to the embodiment of the present invention is 115 GPa or more, more preferably 120 GPa or more. A spring deflection coefficient is a value calculated from the amount of deflection when a load is applied to a cantilever in a range that does not exceed the elastic limit. Indicators of an elastic modulus also include a Young's modulus obtained by a tensile test, but the spring deflection coefficient has a better correlation with contact force in the plate spring contact of a connector or the like. The bending deflection coefficient of a conventional Corson alloy plate is about 110 GPa. By adjusting this at 115 GPa or more, the contact force clearly improves after the Corson alloy plate is worked into a connector or the like, and the Corson alloy plate is clearly less likely to deform elastically against external force after it is worked into a heat-dissipating plate or the like.

For the stress relaxation characteristics of the Corson alloy plate according to the embodiment of the present invention, the stress relaxation rate when a stress of 80% of 0.2% proof stress is applied in TD and the Corson alloy plate is maintained at 150° C. for 1000 hours (hereinafter simply described as a stress relaxation rate) is 30% or less, more preferably 20% or less. The stress relaxation rate of a conventional Corson alloy plate is about 40 to 50%. By setting this at 30% or less, an increase in contact electrical resistance accompanying contact force decrease is less likely to occur even if high current is carried after the Corson alloy plate is worked into a connector, and creep deformation is less likely to occur even if heat and external force are simultaneously applied after the Corson alloy plate is worked into a heat-dissipating plate.

(Amounts of Ni, Co, and Si Added)

Ni, Co, and Si precipitate as intermetallic compounds such as Ni—Si, Co—Si, and Ni—Co—Si by appropriate aging treatment. The strength improves by the action of these precipitates, and Ni, Co, and Si dissolved in the Cu matrix decrease by the precipitation, and therefore the electrical conductivity improves. However, when the total amount of Ni and Co is less than 0.8% by mass, or Si is less than 0.2% by mass, it is difficult to obtain a tensile strength of 500 MPa or more and a stress relaxation rate of 15% or less. When the total amount of Ni and Co exceeds 5.0% by mass, or Si exceeds 1.5% by mass, the manufacture of the alloy is difficult due to hot rolling cracking and the like. Therefore, in the Corson alloy according to the present invention, the amount of one or more of Ni and Co added is 0.8 to 5.0% by mass, and the amount of Si added is 0.2 to 1.5% by mass. The amount of one or more of Ni and Co added is more preferably 1.0 to 4.0% by mass, and the amount of Si added is more preferably 0.25 to 0.90% by mass.

(Other Added Elements)

One or more of Sn, Zn, Mg, Fe, Ti, Zr, Cr, Al, P, Mn, B, and Ag can be contained in the Corson alloy in order to improve strength and heat resistance. However, when the amount added is too large, the electrical conductivity may decrease and fall below 30% IACS, or the manufacturability of the alloy may worsen. Therefore, the amount added is 3.0% by mass or less, more preferably 2.5% by mass or less, in the total amount. In addition, in order to obtain the effect of addition, the amount added is preferably 0.001% by mass or more in the total amount.

(Crystal Orientation of Rolled Face)

The crystal orientation index A given by the following formula (hereinafter simply described as an A value) is adjusted at 0.5 or more, more preferably 1.0 or more. Here, $I_{(hkl)}$ and $I_{0(hkl)}$ are a diffraction integrated intensity of (hkl) face obtained for the rolled face and a copper powder, respectively, using an X-ray diffraction method.

$$A=2X_{(111)}+X_{(220)}-X_{(200)}$$

$$X_{(hkl)}=I_{(hkl)}/I_{0(hkl)}$$

When the A value is adjusted at 0.5 or more, the bending deflection coefficient is 115 GPa or more, and simultaneously the stress relaxation characteristics also improve. The upper limit value of the A value is not limited in terms of improvements in the bending deflection coefficient and stress relaxation characteristics, but the A value is typically a value of 10.0 or less.

(Thermal Expansion and Contraction Rate)

When heat is applied to a copper alloy plate, an extremely minute dimensional change occurs. In the present invention, the proportion of this dimensional change is referred to as a "thermal expansion and contraction rate." The present inventor has found that by adjusting the thermal expansion and contraction rate for a Corson copper alloy plate in which the A value is controlled, the stress relaxation rate can be significantly improved.

In the present invention, as the thermal expansion and contraction rate, a dimensional change rate in the rolling direction when the copper alloy plate is heated at 250° C. for 30 minutes is used. The absolute value of this thermal expansion and contraction rate (hereinafter simply described as a thermal expansion and contraction rate) is preferably adjusted at 80 ppm or less, further preferably 50 ppm or less. The lower limit value of the thermal expansion and contraction rate is not limited in terms of the characteristics of the copper alloy plate, but the thermal expansion and contraction rate is rarely 1 ppm or less. By adjusting the thermal expansion and contraction rate at 80 ppm or less in addition to adjusting the A value at 0.5 or more, the stress relaxation rate is 30% or less.

(Thickness)

The thickness of the product is preferably 0.1 to 2.0 mm. When the thickness is too thin, the cross-sectional area of the current-carrying portion decreases, and heat generation when current is carried increases, and therefore the product is unsuitable as the raw material of a connector or the like through which high current is passed. In addition, the product deforms by slight external force, and therefore the product is also unsuitable as the raw material of a heat-dissipating plate or the like. On the other hand, when the thickness is too thick, bending work is difficult. From such viewpoints, more preferred thickness is 0.2 to 1.5 mm. When the thickness is in the above range, the bending workability can be good while heat generation when current is carried is suppressed.

(Applications)

The copper alloy plate according to the embodiment of the present invention can be preferably used in applications for electronic components such as terminals, connectors, relays, switches, sockets, bus bars, lead frames, and heat-dissipating plates used in electrical and electronic equipment, cars, and the like and is particularly useful for applications for high current electronic components such as high current connectors and terminals used in electric cars, hybrid cars, and the like, or applications for heat-dissipating electronic components such as liquid crystal frames used in smartphones and tablet PCs.

(Manufacturing Method)

Electrolytic copper or the like as a pure copper raw material is melted, Ni, Co, Si, and other alloy elements as required are added, and the mixture is cast into an ingot having a thickness of about 30 to 300 mm. This ingot is formed into a plate having a thickness of about 3 to 30 mm by hot rolling and then finished into a strip or foil having the desired thickness and characteristics by cold rolling, solution treatment, aging treatment, final cold rolling, and straightening annealing in this order. After the heat treatment, the pickling, polishing, and the like of the surface may be performed in order to remove the surface oxide film formed during the heat treatment.

The method for adjusting the A value at 0.5 or more is not limited to a particular method, and, for example, the adjustment is possible by the control of hot rolling conditions.

In the hot rolling of the present invention, an ingot heated to 850 to 1000° C. is repeatedly passed between a pair of rolling rolls and finished to the target plate thickness. A reduction ratio per pass influences the A value. Here, a reduction ratio per pass R (%) is a plate thickness decrease rate when the ingot passes between the rolling rolls once, and is given by $R=(T_0-T)/T_0\times100$ ($T_0$: thickness before passage between the rolling rolls, T: thickness after passage between the rolling rolls).

For this R, it is preferred that the maximum value (Rmax) in all passes is 25% or less, and the average value (Rave) in all passes is 20% or less. By satisfying both these conditions, the A value is 0.5 or more. More preferably, Rave is 19% or less.

In the solution treatment, part or all of the rolled structure is recrystallized to adjust the average crystal grain size of the copper alloy plate at 50 μm or less. When the average crystal grain size is too large, it is difficult to adjust the tensile strength of the product at 500 MPa or more. Using a continuous annealing furnace, at a furnace temperature of 750 to 1000° C., heating time should be appropriately adjusted in the range of 5 seconds to 10 minutes so that the target crystal grain size is obtained.

In the aging treatment, intermetallic compounds such as Ni—Si, Co—Si, and Ni—Co—Si are precipitated to increase the electrical conductivity and tensile strength of the alloy. Using a batch furnace, at a furnace temperature of 350 to 600° C., heating time should be appropriately adjusted in the range of 30 minutes to 30 hours so that maximum tensile strength is obtained.

In the final cold rolling, the material is repeatedly passed between a pair of rolling rolls and finished to the target plate thickness. The reduction ratio of the final cold rolling is preferably 3 to 99%. Here, a reduction ratio r (%) is given by $r=(t_0-t)/t_0\times100$ ($t_0$: plate thickness before rolling, t: plate thickness after rolling). When r is too small, it is difficult to adjust the tensile strength at 500 MPa or more. When r is too large, the edges of the rolled material may crack. The reduction ratio is more preferably 5 to 90%, further preferably 8 to 60%.

By adjusting the thermal expansion and contraction rate of the product at 80 ppm or less in addition to the adjustment of the A value by the control of hot rolling conditions described above, the stress relaxation rate is 30% or less. The method for adjusting the thermal expansion and contraction rate at 80 ppm or less is not limited to a particular method, and, for example, the adjustment is possible by performing straightening annealing under suitable conditions after the final cold rolling.

In other words, by adjusting tensile strength after the straightening annealing at a value 10 to 100 MPa, preferably 20 to 80 MPa, lower than tensile strength before the straightening annealing (after the final cold rolling), the thermal expansion and contraction rate is 80 ppm or less. When the amount of decrease in tensile strength is too small, it is difficult to adjust the thermal expansion and contraction rate at 80 ppm or less. When the amount of decrease in tensile strength is too large, the tensile strength of the product may be less than 500 MPa.

Specifically, by appropriately adjusting heating time in the range of 30 minutes to 30 hours at a furnace temperature of 100 to 500° C. when using a batch furnace, and appropriately adjusting heating time in the range of 5 seconds to 10 minutes at a furnace temperature of 300 to 700° C. when using a continuous annealing furnace, the amount of decrease in tensile strength should be adjusted in the above range.

It is also possible to perform cold rolling between the solution treatment and the aging treatment for higher strength. In this case, the reduction ratio of the cold rolling is preferably 3 to 99%. When the reduction ratio is too low, a higher strength effect is not obtained. When the reduction ratio is too high, the edges of the rolled material may crack.

In addition, it is also possible to perform a plurality of solution treatments for a more sufficient solution. Cold rolling with a reduction ratio of 99% or less can be interposed between individual solution treatments. Further, it is also possible to perform a plurality of aging treatments for more sufficient precipitation. Cold rolling with a reduction ratio of 99% or less can be interposed between individual aging treatments.

EXAMPLES

Examples of the present invention will be shown below with Comparative Examples. These Examples are provided for better understanding of the present invention and advantages thereof and are not intended to limit the invention.

Alloy elements were added to molten copper, and then the mixture was cast into an ingot having a thickness of 200 mm. The ingot was heated at 950° C. for 3 hours and formed into a plate having a thickness of 15 mm by hot rolling. The oxide scale on the plate surface after the hot rolling was ground and removed, and then the plate was finished to product thickness by cold rolling, solution treatment, aging treatment, and final cold rolling in this order. Finally, straightening annealing was performed.

In the hot rolling, the maximum value (Rmax) and average value (Rave) of the reduction ratio per pass were variously changed.

In the solution treatment, a continuous annealing furnace was used, the furnace temperature was 800° C., and the heating time was adjusted between 1 second and 10 minutes to change crystal grain size after the solution treatment.

In the aging treatment, a batch furnace was used, the heating time was 5 hours, and the furnace temperature was adjusted in the range of 350 to 600° C. so that the tensile strength was the maximum.

In the final cold rolling, the reduction ratio (r) was variously changed. In the straightening annealing, a continuous annealing furnace was used, the furnace temperature was 500° C., and the heating time was adjusted between 1 second and 10 minutes to variously change the amount of decrease in tensile strength. In some Examples, the straightening annealing was not performed.

For the material during manufacture and the material (product) after the straightening annealing (after the final cold rolling in Examples in which the straightening annealing was not performed), the following measurement was performed.

(Components)

The alloy element concentration of the material after the straightening annealing was analyzed by ICP-mass spectrometry.

(Average Crystal Grain Size after Solution Treatment)

A cross section orthogonal to the rolling direction was finished into a mirror face by mechanical polishing, and then crystal grain boundaries were allowed to appear by etching. On this metal structure, according to the cutting method in JIS H 0501 (1999), measurement was performed, and the average crystal grain size was obtained.

(Crystal Orientation of Product)

For the rolled face of the material after the straightening annealing, the X-ray diffraction integrated intensities of (hkl) faces ($I_{(hkl)}$) were measured in the thickness direction. In addition, also for a copper powder copper powder (manufactured by KANTO CHEMICAL CO., INC., copper (powder), 2N5, >99.5%, 325 mesh), the X-ray diffraction integrated intensities of (hkl) faces ($I_{0(hkl)}$) were measured. RINT2500 manufactured by Rigaku Corporation was used for the X-ray diffraction apparatus, and measurement was performed with a Cu tube bulb at a tube voltage of 25 kV and a tube current of 20 mA. The measurement faces ((hkl)) were three faces, (111), (220), and (100), and the A value was calculated by the following formula:

$$A=2X_{(111)}+X_{(220)}-X_{(200)}$$

$$X_{(hkl)}=I_{(hkl)}/I_{0(hkl)}$$

(Tensile Strength)

For the materials after the final cold rolling and after the straightening annealing, No. 13B test pieces defined in JIS Z2241 were taken so that the tensile direction was parallel to the rolling direction. In accordance with JIS 22241, a tensile test was performed parallel to the rolling direction, and the tensile strength was obtained.

(Thermal Expansion and Contraction Rate)

A test piece having a strip shape having a width of 20 mm and a length of 210 mm was taken from the material after the straightening annealing so that the longitudinal direction of the test piece was parallel to the rolling direction. Two dents were made with an interval of $L_0$ (=200 mm) as shown in FIG. 1. Then, the test piece was heated at 250° C. for 30 minutes, and the dent interval after the heating (L) was measured. Then, as the thermal expansion and contraction rate (ppm), the absolute value of a value calculated by the formula $(L-L_0)/L_0\times10^6$ was obtained.

(Electrical Conductivity)

A test piece was taken from the material after the straightening annealing so that the longitudinal direction of the test piece was parallel to the rolling direction. The electrical conductivity at 20° C. was measured by a four-terminal method in accordance with JIS H0505.

(Bending Deflection Coefficient)

For the material after the straightening annealing, the TD bending deflection coefficient was measured in accordance with the Japan Copper and Brass Association (JACBA) technical standard "Measuring Method for Factor of Bending Deflection by Cantilever for Copper and Copper Alloy Sheets, Plates and Strips."

A test piece having a strip shape having plate thickness t and width w (=10 mm) was taken so that the longitudinal direction of the test piece was orthogonal to the rolling direction. One end of this sample was fixed, and a load of P (=0.15 N) was applied to a position L (=100 t) from the fixed end. From deflection d at this time, a bending deflection coefficient B was obtained using the following formula:

$$B=4\cdot P\cdot(L/t)^3/(w\cdot d)$$

(Stress Relaxation Rate)

A test piece having a strip shape having a width of 10 mm and a length of 100 mm was taken from the material after the straightening annealing so that the longitudinal direction of the test piece was orthogonal to the rolling direction. As shown in FIG. 2, a deflection of $y_0$ was applied to the test piece with the point of application at a position of 1=50 mm, and stress (s) corresponding to 80% of TD 0.2% proof stress (measured in accordance with JIS 22241) was loaded. $y_0$ was obtained by the following formula:

$$Y_0=(2/3)\cdot l^2\cdot s/(E\cdot t)$$

wherein E is the TD bending deflection coefficient, and t is the thickness of the sample. After heating at 150° C. for 1000 hours, the stress (s) was unloaded, the amount of permanent deformation (height) y was measured as shown in FIG. 3, and the stress relaxation rate {[y (mm)/$y_0$ (mm)]×100(%)} was calculated.

The alloy composition of each sample is shown in Table 1, and manufacturing conditions and evaluation results are shown in Table 2. The description "<10" in crystal grain size after solution treatment in Table 2 includes both a case where all of the rolled structure recrystallizes and its average crystal grain size is less than 10 μm, and a case where only part of the rolled structure recrystallizes.

In addition, in Table 3, as the finished thickness of the material in each pass and the reduction ratio per pass in hot rolling, those of Inventive Example 1, Inventive Example 4, Comparative Example 1, and Comparative Example 4 in Table 1 are illustrated.

TABLE 1

| | Product | Components (% by mass) | | | |
|---|---|---|---|---|---|
| No. | thickness (mm) | Ni | Co | Si | Sn, Zn, Mg, Fe, Ti, Zr, Cr, Al, P, Mn, Ag, B |
| Inventive Example 1 | 0.15 | 2.6 | — | 0.58 | 0.5Sn, 0.4Zn |
| Inventive Example 2 | 0.15 | 2.6 | — | 0.58 | 0.5Sn, 0.4Zn |
| Inventive Example 3 | 0.15 | 2.6 | — | 0.58 | 0.5Sn, 0.4Zn |
| Inventive Example 4 | 0.15 | 2.6 | — | 0.58 | 0.5Sn, 0.4Zn |
| Inventive Example 5 | 0.25 | — | 1.9 | 0.44 | — |
| Inventive Example 6 | 0.25 | — | 1.9 | 0.44 | 0.1Cr, 0.1Ag |
| Inventive Example 7 | 0.25 | — | 1.3 | 0.30 | — |
| Inventive Example 8 | 0.30 | 1.6 | — | 0.36 | 0.5Sn, 0.4Zn |
| Inventive Example 9 | 0.30 | 1.6 | — | 0.36 | 0.5Sn, 1.0Zn |
| Inventive Example 10 | 0.30 | 1.6 | — | 0.36 | 0.5Sn, 0.4Zn |
| Inventive Example 11 | 0.30 | 1.6 | — | 0.36 | 0.5Sn, 0.4Zn |
| Inventive Example 12 | 0.60 | 1.8 | 1.10 | 0.62 | 0.1Cr |
| Inventive Example 13 | 0.60 | 1.8 | 1.10 | 0.62 | — |
| Inventive Example 14 | 0.60 | 1.8 | 1.10 | 0.62 | 0.1Cr |
| Inventive Example 15 | 0.60 | 2.5 | 0.50 | 0.69 | 0.1Mg |
| Inventive Example 16 | 0.10 | 3.8 | — | 0.81 | 0.1Mg, 0.2Mn |
| Inventive Example 17 | 0.10 | 4.0 | — | 0.85 | 0.5Zn, 0.2Sn, 0.1Mg, 0.2Cr |
| Inventive Example 18 | 0.10 | 3.8 | — | 0.81 | 0.1Mg, 0.2Mn |
| Inventive Example 19 | 0.25 | 2.3 | — | 0.46 | 0.2Mg |
| Inventive Example 20 | 0.15 | 3.0 | — | 0.67 | 0.3Sn, 1.7Zn, 0.02P |
| Inventive Example 21 | 0.30 | 2.5 | — | 0.47 | 0.05Fe, 0.05Al |
| Inventive Example 22 | 0.15 | 2.5 | — | 0.47 | 0.03Zr, 0.03Ti |

TABLE 1-continued

| No. | Product thickness (mm) | Components (% by mass) Ni | Co | Si | Sn, Zn, Mg, Fe, Ti, Zr, Cr, Al, P, Mn, Ag, B |
|---|---|---|---|---|---|
| Inventive Example 23 | 0.80 | 1.5 | — | 0.30 | — |
| Inventive Example 24 | 1.20 | 1.2 | — | 0.25 | 0.01B |
| Inventive Example 25 | 0.25 | — | 1.9 | 0.44 | — |
| Inventive Example 26 | 0.15 | 2.6 | — | 0.58 | 0.5Sn, 0.4Zn |
| Inventive Example 27 | 0.15 | 2.6 | — | 0.58 | 0.5Sn, 0.4Zn |
| Comparative Example 1 | 0.15 | 2.6 | — | 0.58 | 0.5Sn, 0.4Zn |
| Comparative Example 2 | 0.10 | 3.8 | — | 0.81 | 0.1Mg, 0.2Mn |
| Comparative Example 3 | 0.30 | 1.6 | — | 0.36 | 0.5Sn, 0.4Zn |

TABLE 1-continued

| No. | Product thickness (mm) | Components (% by mass) Ni | Co | Si | Sn, Zn, Mg, Fe, Ti, Zr, Cr, Al, P, Mn, Ag, B |
|---|---|---|---|---|---|
| Comparative Example 4 | 0.15 | 2.6 | — | 0.58 | 0.5Sn, 0.4Zn |
| Comparative Example 5 | 0.60 | 1.8 | 1.10 | 0.62 | 0.1Cr |
| Comparative Example 6 | 0.25 | — | 1.9 | 0.44 | — |
| Comparative Example 7 | 0.15 | 2.6 | — | 0.58 | 0.5Sn, 0.4Zn |
| Comparative Example 8 | 0.30 | 1.6 | — | 0.36 | 0.5Sn, 0.4Zn |
| Comparative Example 9 | 0.30 | 1.6 | — | 0.36 | 0.5Sn, 0.4Zn |

— indicates no addition.

TABLE 2

| No. | Hot rolling conditions: Maximum reduction ratio, Rmax (%) | Hot rolling conditions: Average reduction ratio, Rave (%) | Solution treatment conditions Crystal grain size (μm) | Final rolling conditions Reduction ratio, r (%) | Straightening annealing conditions Decrease in tensile strength (MPa) | After straightening annealing (product): Thermal expansion and contraction rate (ppm) | Crystal orientation index, A | Tensile strength (MPa) | Electrical conductivity (% IACS) | Bending deflection coefficient (GPa) | Stress relaxation rate (%) |
|---|---|---|---|---|---|---|---|---|---|---|---|
| Inventive Example 1 | 19.6 | 16.9 | 10 | 20 | 40 | 7 | 8.3 | 816 | 40 | 132 | 15 |
| Inventive Example 2 | 21.2 | 18.3 | 10 | 20 | 33 | 10 | 3.8 | 822 | 41 | 128 | 16 |
| Inventive Example 3 | 23.5 | 18.5 | 10 | 20 | 15 | 65 | 1.5 | 843 | 40 | 121 | 24 |
| Inventive Example 4 | 24.4 | 19.4 | 10 | 20 | 29 | 25 | 0.9 | 825 | 41 | 119 | 14 |
| Inventive Example 5 | 19.2 | 17.3 | 20 | 30 | 23 | 36 | 2.3 | 679 | 64 | 128 | 18 |
| Inventive Example 6 | 22.5 | 19.0 | 20 | 30 | 22 | 25 | 1.4 | 681 | 65 | 121 | 17 |
| Inventive Example 7 | 20.6 | 18.3 | 20 | 30 | 22 | 46 | 1.7 | 628 | 67 | 125 | 15 |
| Inventive Example 8 | 22.6 | 18.8 | <10 | 10 | 65 | 8 | 1.6 | 597 | 43 | 126 | 17 |
| Inventive Example 9 | 21.8 | 18.4 | <10 | 30 | 66 | 4 | 1.8 | 702 | 41 | 124 | 18 |
| Inventive Example 10 | 21.8 | 19.9 | <10 | 10 | 64 | 7 | 0.7 | 600 | 42 | 116 | 15 |
| Inventive Example 11 | 22.6 | 18.5 | 20 | 50 | 37 | 12 | 1.9 | 753 | 41 | 124 | 16 |
| Inventive Example 12 | 21.5 | 18.5 | 10 | 40 | 29 | 30 | 1.5 | 861 | 47 | 128 | 18 |
| Inventive Example 13 | 21.8 | 18.1 | 10 | 40 | 30 | 26 | 1.2 | 855 | 47 | 125 | 16 |
| Inventive Example 14 | 21.5 | 18.4 | 10 | 40 | 28 | 13 | 1.3 | 863 | 46 | 126 | 18 |
| Inventive Example 15 | 21.7 | 18.3 | 10 | 20 | 30 | 17 | 2.0 | 834 | 45 | 125 | 17 |
| Inventive Example 16 | 19.6 | 16.8 | 30 | 30 | 24 | 25 | 5.1 | 943 | 38 | 134 | 9 |
| Inventive Example 17 | 20.3 | 17.2 | 30 | 30 | 23 | 22 | 3.3 | 974 | 37 | 130 | 12 |
| Inventive Example 18 | 20.3 | 17.2 | 30 | 30 | 10 | 76 | 3.3 | 969 | 38 | 130 | 21 |
| Inventive Example 19 | 20.9 | 18.3 | 10 | 20 | 28 | 32 | 1.0 | 782 | 48 | 124 | 15 |
| Inventive Example 20 | 21.4 | 18.4 | <10 | 40 | 35 | 18 | 1.6 | 752 | 44 | 122 | 18 |
| Inventive Example 21 | 22.3 | 18.2 | 20 | 30 | 29 | 21 | 2.5 | 847 | 41 | 128 | 13 |
| Inventive Example 22 | 20.6 | 17.8 | <10 | 30 | 33 | 19 | 1.9 | 847 | 39 | 126 | 14 |
| Inventive Example 23 | 19.9 | 17.0 | 40 | 40 | 34 | 24 | 3.4 | 589 | 59 | 125 | 10 |
| Inventive Example 24 | 20.5 | 17.5 | 10 | 20 | 35 | 12 | 2.8 | 545 | 54 | 127 | 16 |
| Inventive Example 25 | 21.6 | 18.7 | 20 | 30 | 6 | 94 | 2.0 | 694 | 65 | 123 | 37 |

TABLE 2-continued

| No. | Hot rolling conditions: Maximum reduction ratio, Rmax (%) | Hot rolling conditions: Average reduction ratio, Rave (%) | Solution treatment conditions Crystal grain size (μm) | Final rolling conditions Reduction ratio, r (%) | Straightening annealing conditions Decrease in tensile strength (MPa) | After straightening annealing (product): Thermal expansion and contraction rate (ppm) | Crystal orientation index, A | Tensile strength (MPa) | Electrical conductivity (% IACS) | Bending deflection coefficient (GPa) | Stress relaxation rate (%) |
|---|---|---|---|---|---|---|---|---|---|---|---|
| Inventive Example 26 | 19.5 | 16.6 | 10 | 20 | 3 | 83 | 7.1 | 850 | 40 | 133 | 31 |
| Inventive Example 27 | 19.7 | 16.7 | 10 | 20 | 0 | 113 | 6.4 | 856 | 40 | 131 | 43 |
| Comparative Example 1 | 27.9 | 18.0 | 10 | 20 | 27 | 20 | 0.3 | 832 | 40 | 112 | 33 |
| Comparative Example 2 | 28.1 | 17.9 | 30 | 30 | 24 | 25 | 0.4 | 946 | 38 | 112 | 34 |
| Comparative Example 3 | 30.8 | 19.7 | <10 | 10 | 57 | 10 | 0.1 | 608 | 43 | 111 | 34 |
| Comparative Example 4 | 23.5 | 20.9 | 10 | 20 | 31 | 12 | 0.2 | 821 | 40 | 113 | 35 |
| Comparative Example 5 | 23.3 | 20.3 | 10 | 40 | 29 | 17 | 0.4 | 863 | 46 | 114 | 35 |
| Comparative Example 6 | 25.8 | 21.5 | 20 | 30 | 24 | 30 | −0.9 | 677 | 65 | 109 | 35 |
| Comparative Example 7 | 26.5 | 22.0 | 10 | 20 | 39 | 8 | −0.2 | 816 | 41 | 110 | 36 |
| Comparative Example 8 | 22.6 | 18.3 | <10 | 1 | 24 | 20 | 1.7 | 491 | 43 | 123 | 15 |
| Comparative Example 9 | 19.8 | 17.0 | 60 | 10 | 25 | 26 | 4.4 | 493 | 42 | 133 | 14 |

TABLE 3

| Pass | Inventive Example 1: Thickness (mm) | Inventive Example 1: Reduction ratio (%) | Inventive Example 4: Thickness (mm) | Inventive Example 4: Reduction ratio (%) | Comparative Example 1: Thickness (mm) | Comparative Example 1: Reduction ratio (%) | Comparative Example 4: Thickness (mm) | Comparative Example 4: Reduction ratio (%) |
|---|---|---|---|---|---|---|---|---|
| 0 | 200 | — | 200 | — | 200 | — | 200 | |
| 1 | 175 | 12.5 | 175 | 12.5 | 174 | 13.0 | 164 | 18.0 |
| 2 | 148 | 15.4 | 145 | 17.1 | 148 | 14.9 | 133 | 18.9 |
| 3 | 123 | 16.9 | 120 | 17.2 | 123 | 16.9 | 107 | 19.5 |
| 4 | 102 | 17.1 | 100 | 16.7 | 102 | 17.1 | 86 | 19.6 |
| 5 | 82 | 19.6 | 81 | 19.0 | 83 | 18.6 | 66 | 23.3 |
| 6 | 67 | 18.3 | 66 | 18.5 | 68 | 18.1 | 51 | 22.7 |
| 7 | 55 | 17.9 | 52 | 21.2 | 49 | 27.9 | 39 | 23.5 |
| 8 | 45 | 18.2 | 41 | 21.2 | 40 | 18.4 | 30 | 23.1 |
| 9 | 37 | 17.8 | 31 | 24.4 | 33 | 17.5 | 23 | 23.3 |
| 10 | 30 | 18.9 | 24 | 22.6 | 27 | 18.2 | 18 | 21.7 |
| 11 | 25 | 16.7 | 19 | 20.8 | 22 | 18.5 | 15 | 16.7 |
| 12 | 21 | 16.0 | 15 | 21.1 | 18 | 18.2 | — | — |
| 13 | 18 | 14.3 | — | — | 15 | 16.7 | — | — |
| 14 | 15 | 16.7 | — | — | — | — | — | — |
| Maximum reduction ratio | — | 19.6 | — | 24.4 | — | 27.9 | — | 23.5 |
| Average reduction ratio | — | 16.9 | — | 19.4 | — | 18.0 | — | 20.9 |

In the copper alloy plates of Inventive Examples 1 to 27, one or more of Ni and Co were adjusted at 0.8 to 5.0% by mass, Si was adjusted at 0.2 to 1.5% by mass, Rmax and Rave were 25% or less and 20% or less respectively in the hot rolling, the crystal grain size was adjusted at 50 μm or less in the solution treatment, and the reduction ratio was 3 to 99% in the final cold rolling. As a result, the A value was 0.5 or more, and an electrical conductivity of 30% IACS or more, a tensile strength of 500 MPa or more, and a bending deflection coefficient of 115 GPa or more were obtained.

Further, in Inventive Examples 1 to 24, the tensile strength was decreased by 10 to 100 MPa in the straightening annealing after the final rolling, and therefore the thermal expansion and contraction rate was 80 ppm or less, and as a result a stress relaxation rate of 30% or less was also obtained. On the other hand, in Inventive Examples 25 to 26, the amount of tensile strength decrease in the straightening annealing was less than 10 MPa, and in Inventive Example 27, the straightening annealing was not carried out. Therefore, the thermal expansion and contraction rate exceeded 80 ppm, and as a result the stress relaxation rate exceeded 30%.

In Comparative Examples 1 to 7, Rmax or Rave was outside the definition in the present invention, and therefore the A value was less than 0.5. As a result, the bending deflection coefficient was less than 115 GPa. Further, although the thermal expansion and contraction rate was adjusted at 80 ppm or less by performing straightening annealing under conditions for decreasing the tensile strength by 10 to 100 MPa, the stress relaxation rate exceeded 30%.

In Comparative Example 8, the reduction ratio in the final cold rolling was less than 3%, and in Comparative Example 9, the crystal grain size after the solution treatment exceeded 50 μm. Therefore, the tensile strength after the straightening annealing was less than 500 MPa.

The invention claimed is:

1. A copper alloy plate consisting of the following 0.8 to 5.0% by mass of Co and 0.2 to 1.5% by mass of Si, with the balance being copper and unavoidable impurities, the copper alloy having a tensile strength of 500 MPa or more, and having an A value of 0.5 or more, the A value being given by the following formula:

$$A=2X_{(111)}+X_{(220)}-X_{(200)}$$

$$X_{(hkl)}=I_{(hkl)}/I_{0(hkl)}$$

wherein $I_{(hkl)}$ and $I_{0(hkl)}$ are diffraction integrated intensities of a (hkl) face obtained for a rolled face and a copper powder, respectively, using an X-ray diffraction method, and wherein a thermal expansion and contraction rate in a rolling direction is adjusted to 80 ppm or less when the copper alloy plate is heated at 250° C. for 30 minutes.

2. A copper alloy plate consisting of the following 0.8 to 5.0% by mass of Co, 0.2 to 1.5% by mass of Si, and 3.0% by mass or less of one or more of Sn, Zn, Mg, Fe, Ti, Zr, Cr, Al, P, Mn, B, and Ag in a total amount, with the balance being copper and unavoidable impurities, the copper alloy having a tensile strength of 500 MPa or more, and having an A value of 0.5 or more, the A value being given by the following formula:

$$A=2X_{(111)}+X_{(220)}-X_{(200)}$$

$$X_{(hkl)}=I_{(hkl)}/I_{0(hkl)}$$

wherein $I_{(hkl)}$ and $I_{0(hkl)}$ are diffraction integrated intensities of a (hkl) face obtained for a rolled face and a copper powder, respectively, using an X-ray diffraction method, and wherein a thermal expansion and contraction rate in a rolling direction is adjusted to 80 ppm or less when the copper alloy plate is heated at 250° C. for 30 minutes.

3. The copper alloy plate according to claim 1 or 2, having an electrical conductivity of 30% IACS or more and having a bending deflection coefficient of 115 GPa or more in a plate width direction.

4. The copper alloy plate according to claim 1 or 2, having an electrical conductivity of 30% IACS or more, having a bending deflection coefficient of 115 GPa or more in a plate width direction, and having a stress relaxation rate of 30% or less in the plate width direction after being maintained at 150° C. for 1000 hours.

5. A high current electronic component using the copper alloy plate according to claim 1 or 2.

6. A heat-dissipating electronic component using the copper alloy plate according to claim 1 or 2.

* * * * *